United States Patent [19]

Bylund

[11] 4,087,311

[45] May 2, 1978

[54] CARPET MACHINE

[75] Inventor: Don M. Bylund, Spartanburg, S.C.

[73] Assignee: Milliken Research Corporation, Spartanburg, S.C.

[21] Appl. No.: 790,254

[22] Filed: Apr. 25, 1977

Related U.S. Application Data

[60] Continuation of Ser. No. 369,081, Jun. 11, 1973, abandoned, which is a division of Ser. No. 221,301, Jan. 27, 1972, Pat. No. 3,840,413.

[51] Int. Cl.[2] ..... B32B 31/00; B32B 5/02; D05C 17/02

[52] U.S. Cl. ..... 156/511; 156/519; 156/543; 156/552

[58] Field of Search ..... 156/72, 265, 298, 256, 156/303, 435, 511, 519, 561, 562, 578, 362, 367, 552, 543, 559; 29/125; 100/178

[56] References Cited

U.S. PATENT DOCUMENTS

| | | | |
|---|---|---|---|
| 523,358 | 7/1894 | Lawrence | 118/DIG. 15 |
| 2,292,851 | 8/1942 | Tykal | 29/125 X |
| 2,461,860 | 2/1949 | Victor | 156/72 X |
| 2,544,965 | 3/1951 | Rogers | 29/125 X |
| 3,415,209 | 12/1968 | Ellison et al. | 156/72 X |
| 3,477,889 | 11/1969 | Partensky | 156/72 |
| 3,531,343 | 9/1970 | Couquet | 156/72 |
| 3,565,710 | 2/1971 | Garvin | 156/72 |
| 3,580,761 | 5/1971 | Boultinghouse | 156/72 |
| 3,697,344 | 10/1972 | Temple | 156/72 |

*Primary Examiner*—William A. Powell
*Assistant Examiner*—Thomas Bokan
*Attorney, Agent, or Firm*—Earle R. Marden; H. William Petry

[57] ABSTRACT

A machine and process with colored yarn patterning capability to produce a bonded, cut pile carpet. A series of hollow needle bars are used to supply yarn to a rotary carrier which carries the individual cut fibers into a position where they are selectively ejected into the surface of an adhesive material.

7 Claims, 17 Drawing Figures

CARPET MACHINE

This is a continuation of application Ser. No. 369,081, filed June 11, 1973 now abandoned which is turn is a divisional of application Ser. No. 221,301, filed Jan. 27, 1972, now U.S. Pat. No. 3,804,413 granted Oct. 8, 1974.

Prior to this invention the carpet industry has attempted to develop a relatively simple machine to produce a bonded, cut pile carpet which has the appearance of an Axminster carpet.

Therefore, it is an object of this invention to produce a bonded, cut pile carpet by a machine and process which has colored yarn patterning capability.

Other objects and advantages of the invention will become clearly apparent as the specification proceeds to describe the invention with reference to the accompanying drawings, in which.

Figure 1:
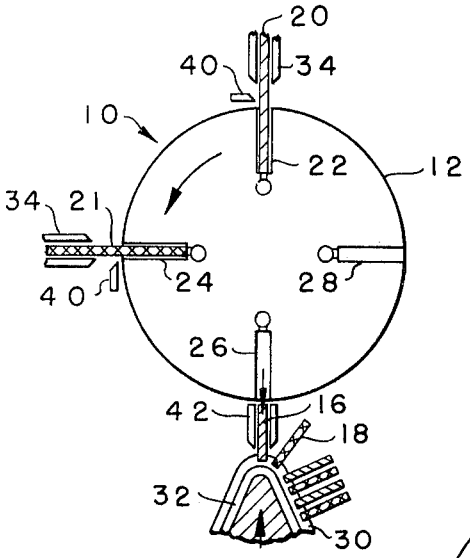
FIGS. 1–5 represent schematically the basic concept of the invention.

Looking now to FIGS. 1–6, the basic concepts of the invention will be explained. The yarn collector and distributor cylinder 10 consists of a plurality of discs 12 which have a plurality of radial openings therein to accommodate bits of yarn 16 and 18 cut off from the respective yarn supplies 20 and 21. For the sake of illustration four radial holes 22, 24, 26 and 28 are shown in each of the discs 12. The discs are secured together in any suitable manner to provide an elongated right circular cylinder which is mounted on a horizontal axis to supply bits of yarn 16 and 18 in a substantially perpendicular direction into the adhesive surface 30.

Figure 14:
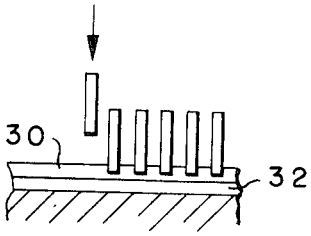
FIGS. 14–16 show various forms of the adhesive surface.
Figure 15:
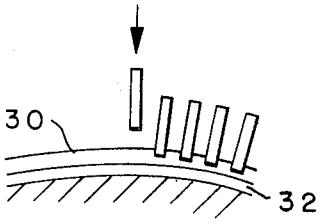
Figure 16:
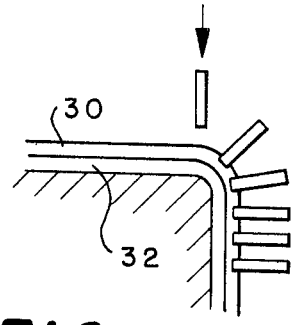

The adhesive surface 30 can be applied to a backing material or, depending on the adhesive, can be applied directly to the conveying surface 32. The particular adhesive could be liquid at the point of yarn insertion requiring heat or time to become a permanent bonding vehicle or could be a hot melt requiring only cooling. The adhesive surface 30 can be planar at the point of yarn insertion as shown in FIGS. 14 and 16 or can be curved at the point of insertion as shown in FIGS. 1–6 and 15.

Figure 17:
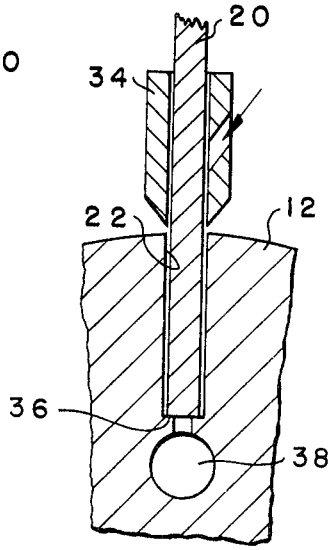
FIG. 17 illustrates one type of yarn feed device.

Looking at FIG. 17 a typical yarn feed is illustrated in that air is aspirated into the needle 34 to suck the yarn 20 into the radial opening 22 until it bottoms on the bottom 36 of the opening. If desired, the passage 38 can be vented to atmosphere to allow the yarn to be more readily fed into the opening 22. In the desired form of the invention the length of the yarn 20 to be cut is determined by the depth of the opening 22 but other devices, such as a solenoid controlled stepping motor, can be used to deliver a desired length of yarn into the opening 22. As shown in FIGS. 1–5 the yarn bits are cut from the yarn supplies 20 and 21 by a fixed knife blade 40, or other suitable means such as a shear, band knife or sickle bar cutter, located adjacent the yarn supply so that it engages the yarn as the yarn distributor rotates to sever the bits from the yarn supply.

Figure 9:
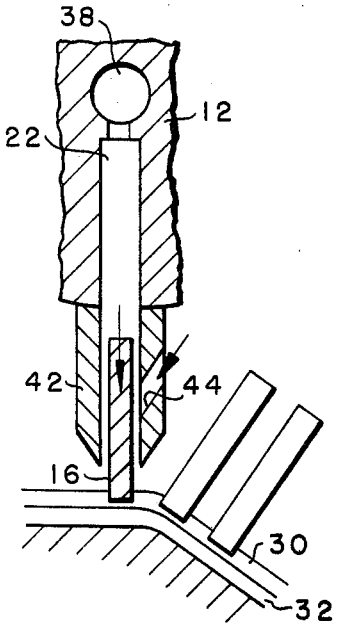
FIGS. 9–11 are blown-up views of the yarn collector and distributor cylinder to show the yarn ejection cycle.
Figure 10:
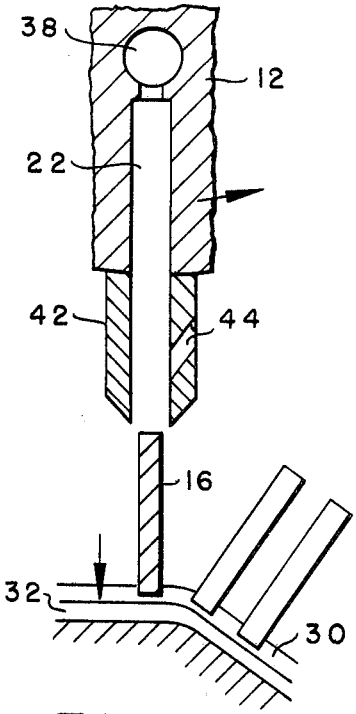
Figure 11:
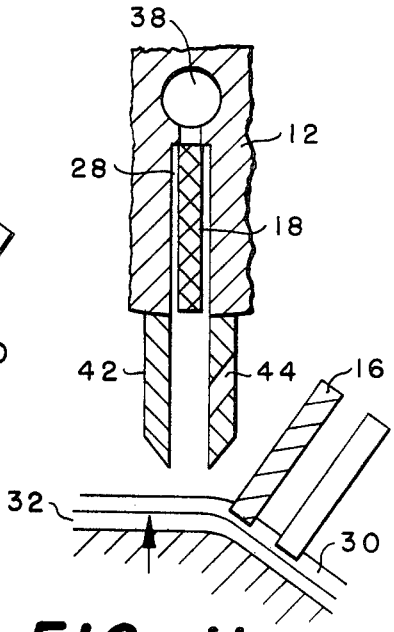
Figure 12:
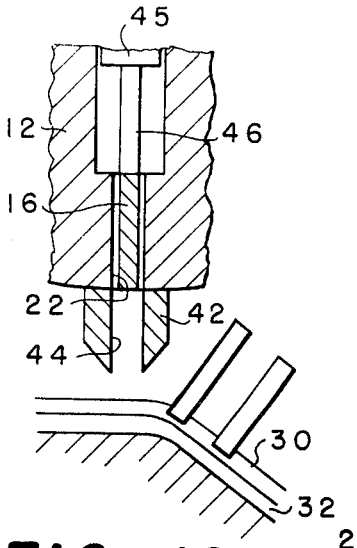
FIGS. 12 and 13 show an alternative method of ejecting the yarn into the adhesive surface.
Figure 13:
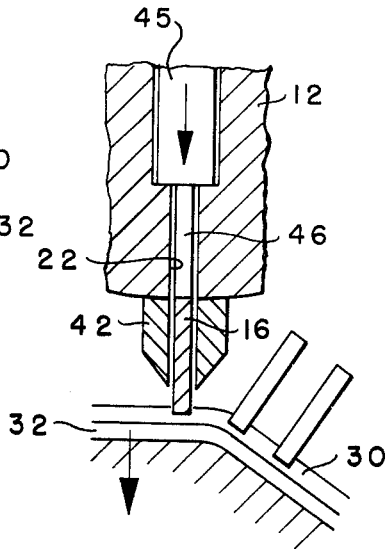

FIGS. 9–11 show the preferred yarn release and bit inserter device and FIGS. 12 and 13 show an alternative device. In FIGS. 9–11 when the cylinder 12 rotates to a position where one of the radial holes, such as 22, is lined up with the hollow needle 42 and it is desired to insert the bit of yarn 16 into the adhesive layer 30, the passage 38 is vented to atmosphere and air is aspirated into the needle 42 through opening 44 to insert the yarn bit 16 into the adhesive layer 30. Then the conveying surface 32 is moved downward (FIG. 10) so that the yarn bit 16 clears the bottom of the needle 42. Then the conveying surface is moved downstream from the needle and upward for receipt of another row of yarn bits if the row of yarn is complete with the proper colors. At the same time the cylinder 12 has rotated counterclockwise to place another radial opening, such as 28, into communication with the hollow needle 42.

FIGS. 12 and 13 illustrate another type of yarn inserter which may be employed to implant yarn bits 16 into the adhesive layer 30. The yarn inserter of FIGS. 12 and 13 is a mechanical type which uses a plunger 45 and plunger rod 46 to mechanically push the yarn bit 16 into the adhesive surface 30. The plunger 46 can be actuated by any suitable means such as a cam, solenoid, etc.

It is understood that there are a series of yarn supply devices and yarn delivery devices lined up in a substantially parallel position to supply a multiplicity of yarn bits into the adhesive surface 30 at one time to produce a row of yarn bits.

FIGS. 1–5 represent schematically the operation of one disc of one cylinder 10. For the sake of discussion, let us assume it is desired to provide a carpet with a two color yarn effect. The control of the yarn into and out of the radial opening, as well as the rotation of the cylinder 10, is automatic and preselected to provide the desired effect in the finished product. If N represents the number of yarn colors required, the discs 12 will have 2N openings therein as indicated by the openings 22, 24, 26 and 28 since a two color yarn effect is desired. The number of openings in the disc 12 for any N is such that there will be N openings in a position to be fed yarn, N-1 openings empty or idle and one opening in a position to release yarn into the adhesive layer. The control is so selected that only one color yarn is released at any one time so each indexing rotation of the cylinder 10 is $\pi/N$ radians. Thus the maximum number of indexes necessary for a given yarn color to become available at the release station at a given place in the pattern also will be N. To express it another way, if it is desired that all colors are to be placed in a single row in the adhesive the cylinder 10 will be rotated or indexed N times before the backing 32 is moved to make another row in the carpet.

Figure 2:
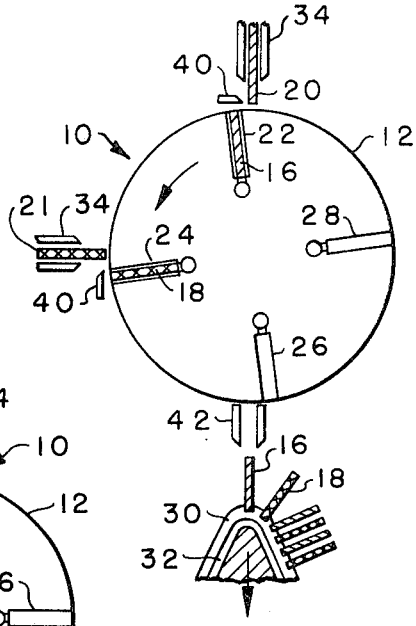
Figure 3:
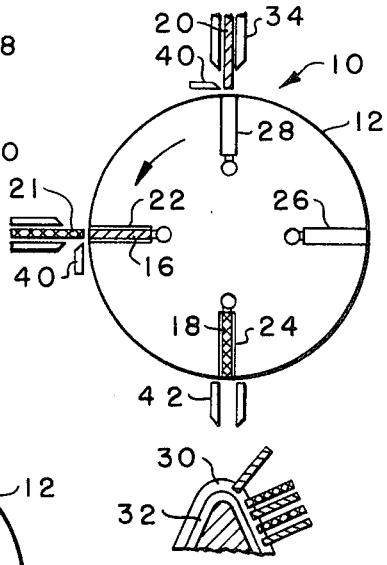
Figure 4:
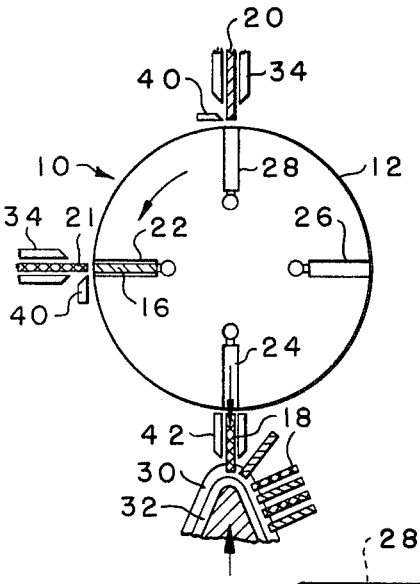
Figure 5:
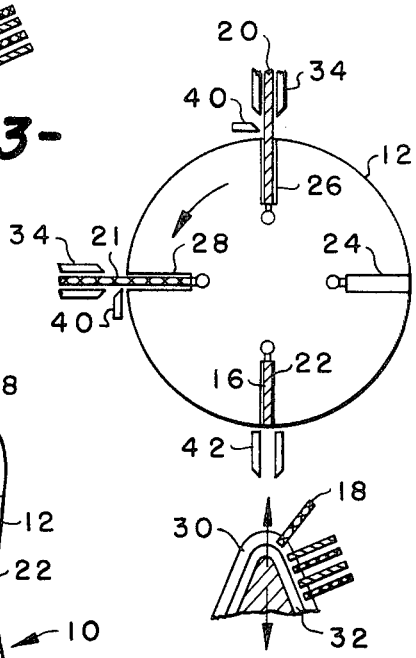
Figure 6:
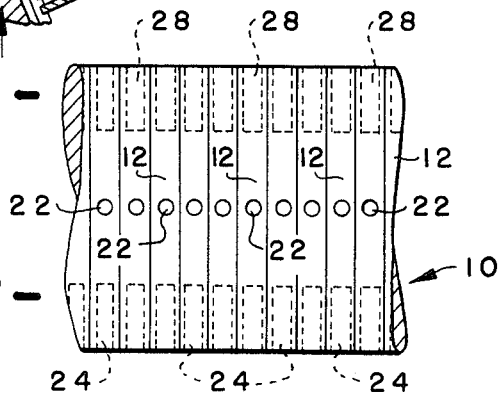
FIG. 6 is a partial view of the yarn collector and distributor cylinder.
Figure 7:
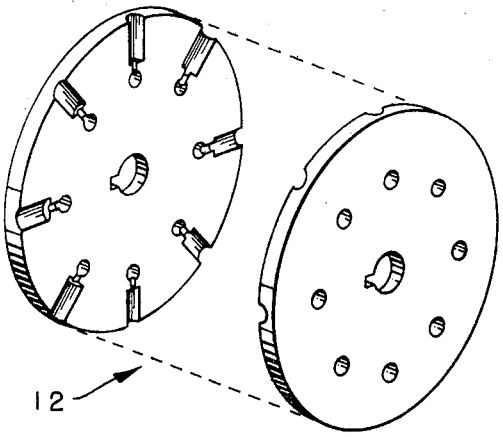
FIGS. 7 and 8 are schematic representations of two forms of the individual discs used in the yarn collector and distributor cylinder.
Figure 8:
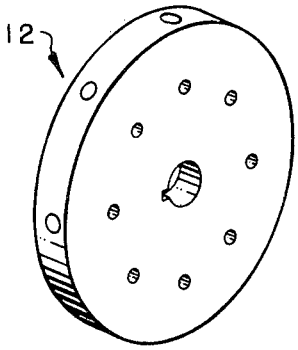

As shown in FIGS. 1–5, one color yarn is supplied only to openings 22 and 26 while the other color yarn is supplied to openings 24 and 28. Looking now to FIG. 1 and assuming that the controls are programmed to do so, one color yarn 20 is being supplied to opening 22 while another color yarn 21 is being supplied to the opening 24. At the same time, yarn bit 16 which has been cut from the yarn supply 20 is being released into the adhesive layer 30. Then, as shown in FIG. 2, the conveying surface 32 is moved downward so that the yarn bit 16 clears the needle 42 and the cylinder 10 starts to rotate to the position shown in FIG. 3. As the cylinder 10 rotates, yarn bits 16 and 18 will be severed from their respective yarn supplies 20 and 21 by the knives 40 appropriately located in the path of travel of the cylinder 10. Then the cylinder 10 reaches the position shown in FIGS. 3 and 4. When the cylinder reaches the position shown in FIG. 3, the conveying surface 32 is moved upward so that the yarn bit 18 can be released into the adhesive surface 30 as shown in FIG. 4. Since yarn bit 16 is located in opening 22 no yarn is supplied from yarn supply 21 and no yarn is supplied from yarn supply 20 into the opening 28. Then, as shown in FIG. 5, the conveying surface 32 is moved downward, indexed one space to receive another row of yarn bits and moved back up into yarn receiving position. At the same time, yarn supply 20 is supplying yarn into opening 26 and yarn supply 21 is supplying yarn into opening 28. Then the procedure is repeated to provide another row of yarn bits.

In the above-described type of system a complicated array of actuating devices is necessary for each disc 12 since each disc has to have actuation at each of N + 1 stations since there is selective release of only one color yarn at the release station, thereby requiring a number of actuation devices equal to (N + 1) × number of discs 12 for the cylinder 10.

As described, the herein-disclosed invention provides apparatus and methods which can be computer controlled for manufacturing bonded, cut pile carpets with colored yarn patterning capability.

Although I have described in detail the preferred embodiments of my invention, I contemplate that many changes may be made without departing from the scope or spirit of my invention and I desire to be limited only by the claims.

That which is claimed is:

1. Apparatus to manufacture a cut, pile fabric comprising: an elongated rotatably mounted member, means forming rows of apertures in said elongated member with at least four apertures in each row, a first yarn supply means located adjacent said elongated member to supply yarn into one of said apertures in each of said rows of apertures at a preselected time, a second yarn supply means located adjacent said elongated member to supply yarn into another of said apertures in each of said rows of apertures at a preselected time, means operably associated with said elongated member and located adjacent at least two of said apertures to sever the yarn supplied into said apertures, means mounting an adhesive layer adjacent said elongated member and means to insert severed yarn from certain preselected apertures into said adhesive layer.

2. The apparatus of claim 1 wherein the number of apertures is at least twice the number of preselected yarn colors.

3. The apparatus of claim 1 wherein said elongated member consists of a plurality of discs mounted together, each disc having a row of said apertures therein.

4. The apparatus of claim 3 wherein the axis of said aperture is perpendicular to the axis of said elongated member.

5. The apparatus of claim 1 wherein said means to insert yarn into said adhesive layer includes a hollow needle and pneumatic means to place the yarn into said layer.

6. The apparatus of claim 1 wherein said means to insert yarn into said adhesive layer includes a hollow needle and mechanical means to place the yarn into said layer.

7. Apparatus to manufacture a cut, pile fabric comprising: an elongated cylindrical rotatably mounted member, means forming rows of apertures in said elongated member with at least four apertures in each row, a first yarn supply means located adjacent said elongated member to supply yarn into one of said apertures in each of said rows of apertures at a preselected time, a second yarn supply means located adjacent said elongated member to supply yarn into another of said apertures in each of said rows of apertures at a preselected time, means operably associated with said elongated member and located adjacent at least two of said apertures to sever the yarn supplied into said apertures, means mounting an adhesive layer adjacent said elongated member and means to insert severed yarn from certain preselected aperture into said adhesive layer.

* * * * *

UNITED STATES PATENT OFFICE

CERTIFICATE OF CORRECTION

Patent No. 4,087,311 Dated May 2, 1978

Inventor(s) Don M. Bylund

It is certified that error appears in the above-identified patent and that said Letters Patent are hereby corrected as shown below:

Column 1, line 4, "is", first occurrence, should be --in--.

Column 1, line 6, "3,804,413" should be --3,840,413--.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*